US005168628A

United States Patent [19]

Mock et al.

[11] Patent Number: 5,168,628

[45] Date of Patent: Dec. 8, 1992

[54] RAZOR

[75] Inventors: Elmar Mock, Bienne; Daniel Schirmer, Tenniken, both of Switzerland

[73] Assignee: Kai Industries Co., Ltd., Seki City, Japan

[21] Appl. No.: 718,557

[22] Filed: Jun. 19, 1991

[30] Foreign Application Priority Data

Jun. 22, 1990 [CH] Switzerland ..... 02097/90

[51] Int. Cl.[5] ..... B26B 21/44

[52] U.S. Cl. ..... 30/41; 30/86; 30/125

[58] Field of Search ..... 30/41, 90, 41.5, 86, 30/125, 123.3, 124

[56] References Cited

U.S. PATENT DOCUMENTS

| | | | |
|---|---|---|---|
| 1,892,836 | 1/1933 | Harvey | 30/41 |
| 2,861,338 | 11/1958 | Boland | 30/41 |
| 2,866,265 | 12/1958 | Kells | 30/41 |
| 3,139,683 | 7/1964 | Waldman | 30/41 |
| 3,417,468 | 12/1968 | Miyauchi | 30/41 |
| 4,023,269 | 5/1977 | Lopez, Jr. | 30/41 |
| 4,074,429 | 2/1978 | Roberts | 30/41 |
| 4,077,119 | 3/1978 | Sellera | 30/41 |
| 4,314,404 | 2/1982 | Ruiz et al. | 30/41 |
| 4,562,644 | 1/1986 | Hitchens | 30/41 |

FOREIGN PATENT DOCUMENTS

| | | | |
|---|---|---|---|
| 4418483 | 6/1990 | European Pat. Off. . | |
| 2494603 | 5/1982 | France . | |
| 2605923 | 5/1988 | France | 30/125 |
| 279398 | 3/1952 | Switzerland . | |
| 488143 | 7/1938 | United Kingdom . | |
| 490808 | 9/1938 | United Kingdom . | |
| 879736 | 10/1961 | United Kingdom . | |

*Primary Examiner*—Douglas D. Watts
*Assistant Examiner*—Hwei-Siu Payer
*Attorney, Agent, or Firm*—Walter C. Farley

[57] ABSTRACT

A shaving apparatus for flat and contour shaving makes it possible to distribute in the form of a think film on the skin just prior to shaving a cosmetic or pharmaceutical preparation. It comprises an applicator part, a feed part and a blade part, the blade part and the applicator part together forming the razor head (1), while the feed part forms the razor handle (4). The preparation is applied by means of a roll (5) or a spatula-like part, on which rotates a thin film of the preparation supply shielded from the outside. The feed device comprises a preparartion reservoir (6) and a miniature pump (5), which is arranged in such a way that it can easily be operated during application by the fingers guiding the razor and consequently during shaving preparation is fed into the applicator. The blade part comprises at least one blade functionally cooperating with the applicator part.

19 Claims, 11 Drawing Sheets

FIG. 3b
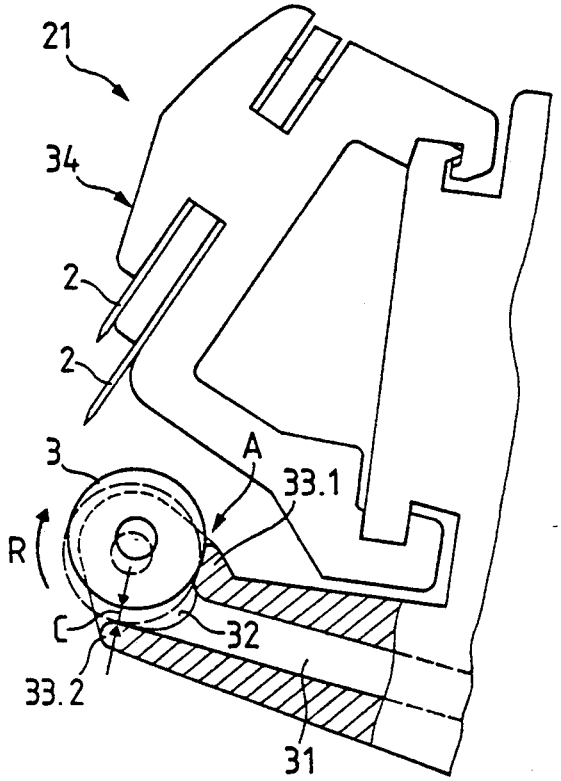
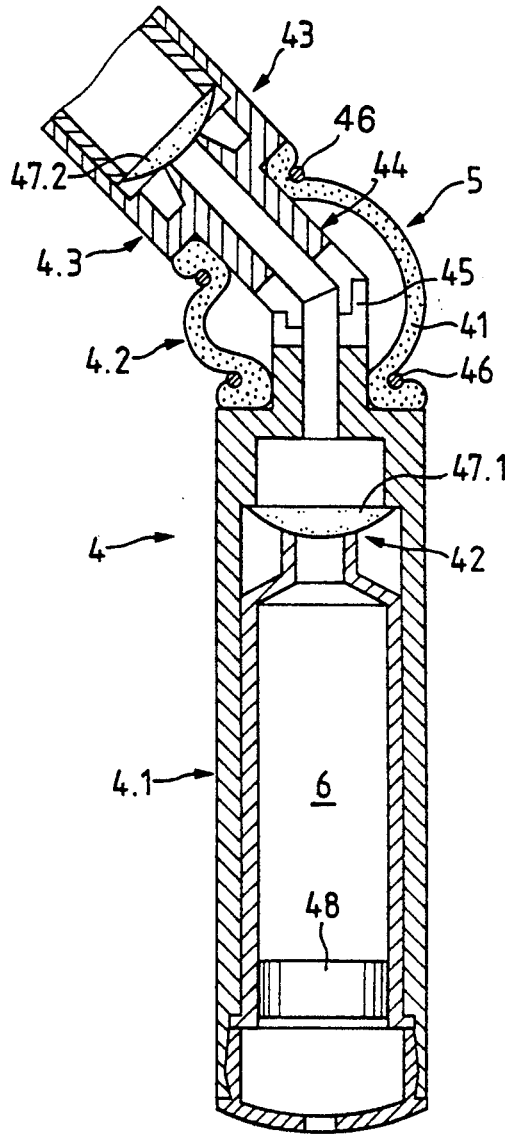
FIG. 4a
FIG. 4b
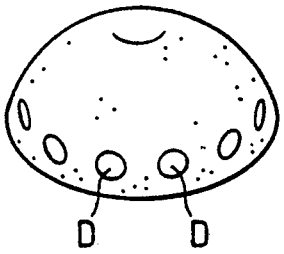
FIG. 4c
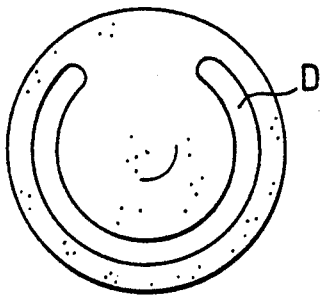
FIG. 4d
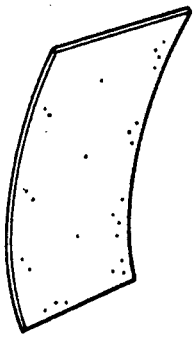

RAZOR

FIELD OF THE INVENTION

The invention relates to the field of personal hygiene and particularly to a shaver or razor for wet shaving (blade shaving) enabling hair to be cut off close to the skin from selected parts of the body (flat, roundness or contour shaving) using any chosen preparation (e.g., problem shaving), which is applied by the razor during shaving.

BACKGROUND OF THE INVENTION

No matter whether specific to men or women, prior to blade shaving it is generally necessary to apply to the skin surface a lubricating and softening agent (eventual problem shaving). The flat application of thin coatings of such cosmetic (optionally pharmaceutical) preparations to the skin is normally performed manually or by a spraying process. A good dosing and a very regular distribution is difficult. It is unavoidable that part of the expensive preparation to be applied will be left behind on the applying hand. In addition to not solving the application problem, spray cans are now no longer desired due to contamination of the environment. Moreover, hygienic problems exist with the known blade shaving procedure.

Thus, e.g., combined preparations for the treatment of body hair prior to shaving and the freshly shaved skin after shaving have been developed and constantly improved by the cosmetics industry. Such preparations are distributed on the skin usually by hand in the form of a liquid, cream or foam prior to shaving. This involves an operation prior to shaving and a highly desired, sparing dosing is not possible. This is particularly a disadvantage when using more recent preparations, which are so effective that even very small quantities, e.g., 150 to 250 mg are completely sufficient for shaving. It is scarcely possible to regularly distribute by hand such a small quantity.

Means have already been developed which make it possible to automatically distribute on the skin during shaving such skin preparations. However, these means are exclusively directed at male-specific shaving. For example, U.S Pat. Nos. 4,074,429; 4,381,293; and 4,562,644 propose applying to the razor or shaver head in solid form a skin preparation in such a way that it is drawn over the skin during shaving in front of the blade or blades and a thin film of the preparation is rubbed onto the skin. However, during use the solid preparation changes shape and its position has to be frequently changed with respect to the blade. In addition, as stated, the preparation must have a solid consistency in order to maintain its shape.

It has also been proposed to apply liquid or foam preparations with sponge material parts fixed to the shaver head (U.S. Pat. Nos. 3,895,437 and 4,314,404) or to use corresponding rubber rolls (U.S. Pat. Nos. 3,677,883 and 2,861,338). However, it is still difficult with such means to apply a regular film of the product to the skin. Thus, no fresh fluid is supplied and instead in a form of recycling the in part consumed fluid is reused. After shaving the remainder of the preparation is rinsed away together with the used preparation. The main function of such means is to avoid a treatment process preceding the actual shaving process. Thus, they are not dosing/applying means and the hygienic problem remains unsolved.

All these means suffer from the lack of a correct interaction between the shaving preparation, its supply to the razor and the blade part. The mere addition of a random portion of the preparation during shaving is inadequate, particularly if additional mechanisms for this purpose are used on existing razors. For the correct interaction it is necessary to have a completely new shaver with matched functional parts.

SUMMARY OF THE INVENTION

An object of the present invention is to provide a razor or shaver enabling the application of a pumpable preparation in the form of a thin, regular coating in a flat and cutting-correct manner. The supply of the regular coating in a flat and cutting-correct manner. The supply of the preparation for application purposes must only be possible during the application or pumping process. During non-application, all the supply paths must be automatically interrupted and shielded. It must be ensured for hygienic reasons that no contaminants can be introduced from the outside into the stored preparation. It must be easily possible for the user to precisely dose the preparation. The apparatus must be suitable for shaving by either men or by women. In the case of female-specific shaving surfaces with more pronounced roundness, i.e., roundness shaving (concave and convex) are involved, whereas in the case of male-specific shaving surfaces with less pronounced roundnesses are mainly involved. However, even in the case of male-specific shaving there is always the problem of "dimples" and this problem can also be solved as a result of the requirements existing with respect to female-specific shaving.

This combination brings about a novel working interaction between the blade and the preparation or a functional interaction of a fluid (the preparation) hygienically housed in a reservoir or tank and which by means of a feed part is supplied to an applicator part, which distributes the fluid in dosed manner to the hair in the cutting-correct location and simultaneously influences the cutting position, assisting the work of the blade part. On setting down the razor the fluid supply is interrupted and brought into a washable or rinsable state, the preparation reservoir being shielded from the outside. Without any additional manipulations, the razor can be again brought into a hygienic state. The shapes of the blade part and applicator part are matched, the feed part together with the reservoir being functionally matched to the applicator part in such a way that the applicator part brings about the dosing to the blade part and the shielding with respect to the feed part. Despite its double function, this intermediate member can be designed in numerous different ways, can be adapted to and blade shape and controls the pumped in flow of fluid from a reservoir.

Preferably, the application opening is slotshaped. The elements defining the opening can be movable or rigid. It they are movable, the mobility can be used for application purposes (e.g., rolls) or for reducing or even covering the opening (e.g., pivot pin of a roll, hinged or elastic lip) or for both of these. The elements defining the opening can be so positioned with respect to the blade part (one or more cutting edges), that cutting is mechanically assisted, so that additional significance is attributed to the geometry of the cutting edge or edges and the opening definition element or elements. the application opening is connected via the feed part to the fluid reservoir, which is shielded by the feed channel and the boundary elements in order to satisfy the hygienic requirements. In addition, the feed part only operates in one direction, e.g., the delivery direction. The following fluid "cleans" the feed channel or channels with respect to infiltrating medium, but as a result of the integrated dosing still has a sparing action. There is once again a double use as a result of the forced delivery direction and the dosability of the razor.

BRIEF DESCRIPTION OF THE DRAWINGS

The aforementioned object is achieved by the inventive apparatus which comprises an applicator part, a fluid feed part and a blade part. The following description and the relevant drawings deal in general with the interaction between the applicator part and the blade part then in detail with the applicator part with the feed part and finally with the integration of the blade part into a razor according to the invention, in which the three parts are used in combination with one another. These components and combinations will be described with reference to the accompanying drawings wherein:

FIG. 3*b* is a side elevation, in partial section, of the head portion of another embodiment of a shaving apparatus in accordance with the invention;

FIG. 4*a* is a side elevation, in section, of the pump, reservoir and handle structure of a further embodiment in accordance with the invention;

FIGS. 4*b*, 4*c* and 4*d* are views of valves usable in the embodiment of FIG. 4*a* and other embodiments;

DESCRIPTION OF THE PREFERRED EMBODIMENTS

Figure 1A:
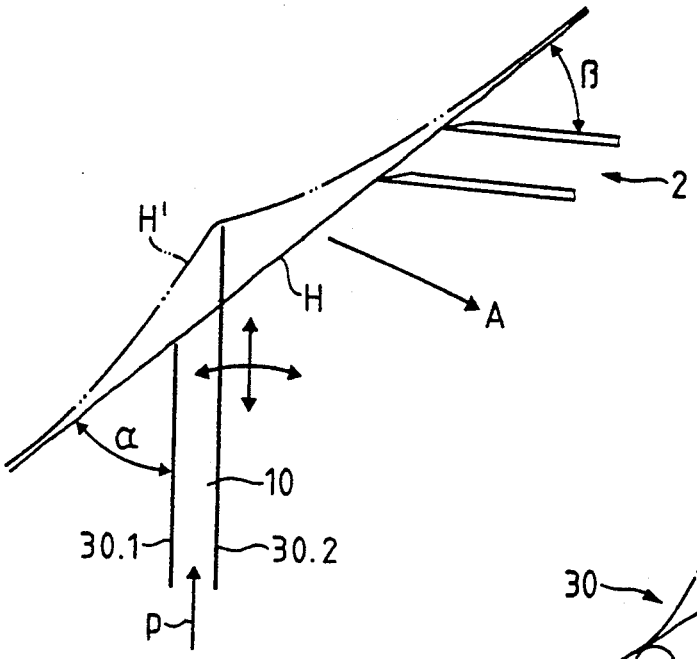
FIG. 1*a* is a schematic diagram, in side elevation, of the basic components of a first embodiment of an apparatus in accordance with the invention.

FIG. 1*a* shows a schematic basic representation of the feed, application and cutting function of an inventive razor or shaver, in which $\alpha$ is an application angle and $\beta$ a cutting angle and in which, for troublefree shaving, the angle $\alpha$ is larger than the angle $\beta$. The two angles relate to the skin surface H. Between the razor parts defining the two angles relative to the skin, i.e., the blades 2 and the outer fluid channel boundary 30.1, is provided an applicator part (manipulation part) 30.2 which influences the cutting angle and which is a part bounding the application opening on the blade-side and which can also close the fluid channel 10. The adjustment possibilities for part 30.2 are illustrated by a crossed double arrow. Moved in the skin surface direction, it causes local depression of the skin surface H into the position H'. It is possible between the blade 2 and the manipulation part 30.2 to remove the shavings A, i.e., the hair and fines of preparation and skin. In the fluid channel, the fluid is conveyed under a given pump pressure to the applicator part (arrow p) and passes out at the application opening in the vicinity of the skin surface. When the blade part is moved in the cutting direction, the applicator part distributes the preparation over the skin surface.

Figure 1B:
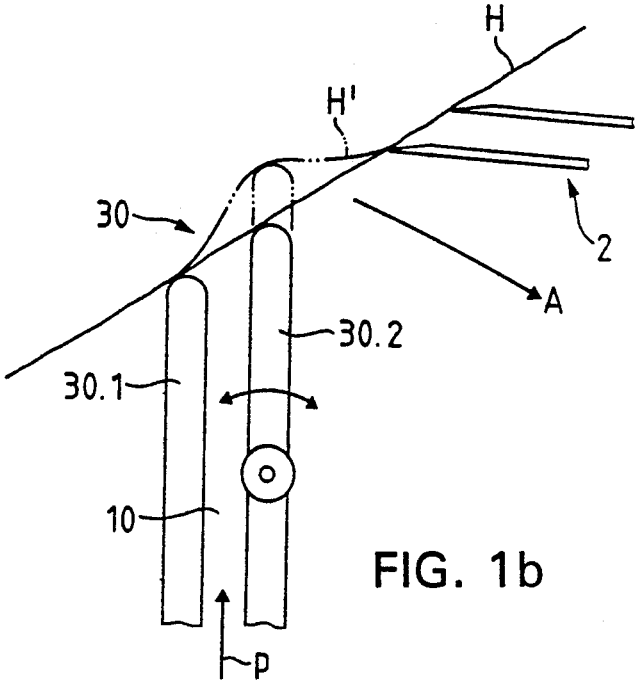
FIG. 1*b* is a diagram similar to FIG. 1.1 with a pivotable spatula applicator.

FIG. 1*b* diagrammatically illustrates an embodiment, in which the fluid channel 10 of the applicator part is constructed with spatula-like wall parts 30.1, 30.2. The applicator part 30.2 (manipulation part), which influences the cutting angle and which is on the one hand a part bounding the application opening on the blade-side and which closes the fluid channel 10 by pivoting back, has its adjustment possibilities illustrated by a double arrow. The position of the skin surface is influenced to a varying degree as a function of the pivotable spatula part length and is indicated by a local depression or sliding back of the skin surface H into the position H'. As a function of the pivotal position and length of the wall part 30.2, there is also a change in the outlet opening formed by the two wall parts 30.1 and 30.2 and through which the fluid passes out in the direction of the skin. If the spatula-shaped manipulation part 30.2 is brought into an inoperative position, in which the outlet opening of the fluid channel 10 is closed, e.g., by means of spring pressure, then movement of the blade part in the cutting direction brings about opening thereof, so that the fluid under pump pressure can pass out in unimpeded manner. It is simultaneously spread over the skin face by the spatula part 30.2.

Figure 1C:
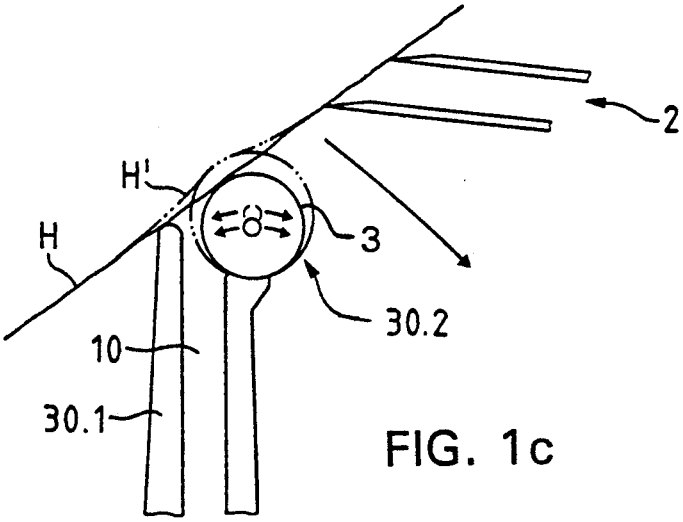
FIG. 1*c* is a diagram similar to FIGS. 1.1 and 1.2 with a roller applicator.

FIG. 1*c* shows another embodiment in which the fluid channel 10 of the applicator part can be closed or at least constricted by a roll-like attachment on the wall parts 30.1, 30.2. The applicator part 30.2 (manipulation part) influencing the cutting angle is e.g., a cylindrical roll 3, which on the one hand bounds the application opening on the blade side and through its position partly covers the fluid channel. The double arrow indicates the adjustment possibilities if the roll 3 is mounted in a slot-like bearing. As a function of the pivotable roll part position, the channel is covered to a grater or lesser extent. As a function of the roll diameter the skin surface is varyingly influenced, i.e., is locally slid back into a position H', as shown in FIG. 1*b*. If the roll-like manipulation part 30.2 is brought into an inoperative position, in which the outlet opening of the fluid channel 10 is closed, e.g., by means of spring pressure, movement of the blade part in the cutting direction brings about an opening thereof, so that the fluid under pump pressure can pass out in unimpeded manner. Simultaneously it is spread onto the skin surface by the roll part 30.2.

Figure 1D:
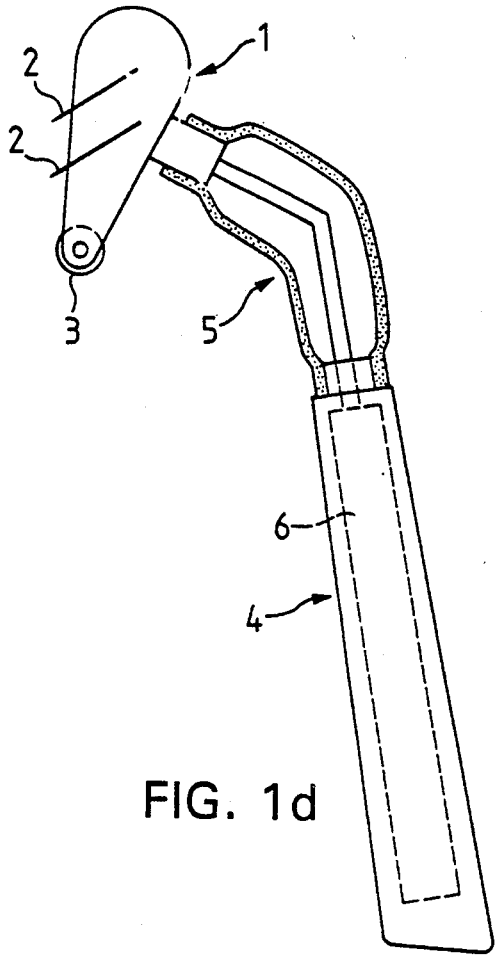
FIG. 1*d* is a simplified side elevation, in partial section, of a razor in accordance with the invention.

FIG. 1*d* is a diagrammatic section through an embodiment of the inventive apparatus, which comprises three parts, namely an applicator, a cutting mechanism and a feed device, from which the preparation is fed into the applicator. The applicator corresponds to the roll embodiment according to FIG. 1*c*. The cutting mechanism is integrated into the applicator, i.e., the cutting mechanism and applicator together from the razor or shaver head 1. The main component of the applicator is an application roll 3 arranged parallel to the blades 2. The feed device is housed in the apparatus handle 4 and comprises a small pump 5 and a reservoir 6.

For shaving purposes the razor head 1 is drawn over the skin with the aid of the handle 4 in such a way that the application roll 3 rolls over the skin directly preceding the blades 2. The pump 5 is positioned in such a way that it is located between the thumb and index finger and, as a function of the embodiment, can be operated by slight alternating pressing and re-releasing. As a result the preparation is pumped out of the reservoir 6 into the applicator and distributed as a thin film on the application roll and is transferred by the latter to the skin. Dosing is simple. The effect of inadequate dosing is the running dry of the application roll, while excessive dosing is manifested by dripping.

The applicator comprises an application roll and a supply system. For application purposes the application roll is rolled over the skin. It is, e.g., mounted in a rotary and pivotable manner, so that it is swung out on rolling in one direction (application direction R), whereas on rolling in the other direction, and when it does not roll, it remains in its inoperative position. The swinging out makes it possible for a thin film of preparation from the supply system on the roll surface to be moved outwards. The application roll shields the supply system from the outside in the inoperative position. In another embodiment, the application roll is fixed and the slot width remains constant. This embodiment is suitable for preparations which are not subject to pronounced drying out and which only have a limited film formation tendency. In yet another embodiment the application roll may only be pivotable and not rotatable, so that it closes and opens the application opening, but for the actual application functions in the same way as an application spatula as described hereinafter.

Figure 2A:
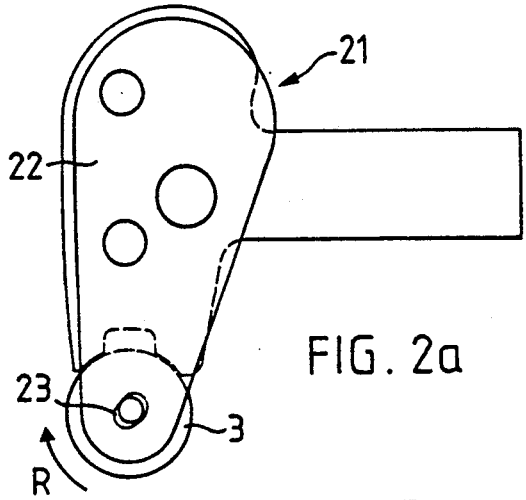
FIG. 2*a* is an enlarged side elevation of the head portion of one embodiment of a razor in accordance with the invention.
Figure 2B:
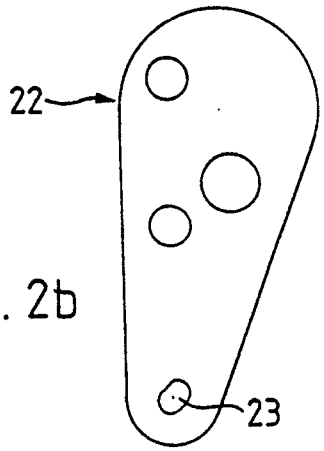
FIG. 2*b* is a side elevation of one embodiment of a bearing part usable in the embodiment of FIG. 2*a;*

FIG. 2*a* shows an applicator from the side. It comprises a roll 3, a head 21 and two bearing parts 22 positioned laterally on opposite sides of the head 21. The bearings 23 in the bearing parts 22 are either designed in such a way that they not only permit rotation of the roll 3 about its pivot pin, but also a pivoting out of the or in such a way that they only permit rotation of the roll and pivot pin. The first variant leads to a variable application slot width and the second variant to a fixed application slot width. FIG. 2*b* separately shows a bearing part 22 in which a variable-width application slot bearing 23 is shown.

Figure 3A:
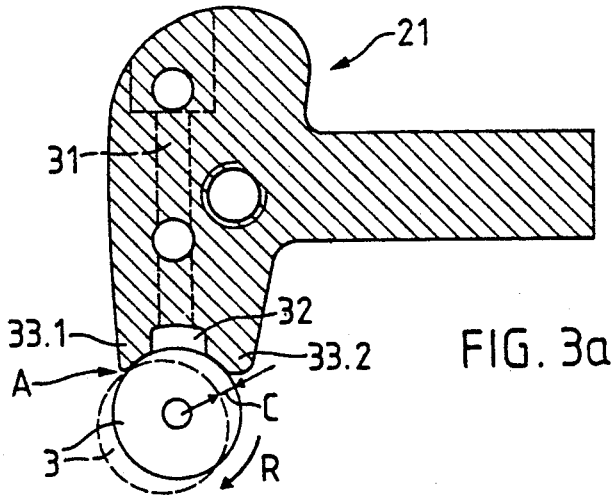
FIG. 3*a* is a side elevation, in section, of the head portion of the razor of FIG. 2*a;*

FIG. 3*a* is a section through the head 21 of the applicator embodiment shown in FIG. 2*a*. A bore 31 for supplying the preparation extends between the rollcarrying end of the head 21 to the connection end of the head. At tee roll end the bore issues into a channel 32 running parallel to the roll 3 and open against the latter. At the connection end the bore is constructed in accordance with the connection to the feed device. The head is shaped to form lips 33.1 and 33.2 at opposite sides of the channel 32.

Unlike in the case of a fixed roll mounting, the bearings of the roll 3 in the bearing parts 22 (c.f. FIG. 2) are designed in such a way that the roll can assume two extreme pivoting positions, namely an "inoperative position" (shown in continuous line form in the drawing) and an "application position" (shown in broken line form in the drawing). If the roll 3 is in its inoperative position, then both the slot A between the lip 33.1 and the roll 3 and the slot C between the lip 33.2 and the roll 3 are so narrow that no preparation can pass out and consequently the channel 32 and the supply system are shielded with respect to the outside. If the roll 3 is moved from the inoperative into the application position, there is no change to the width of the slot A, whereas the slot C widens until in the application position its width corresponds to the desired preparation outlet quantity. The application position for a desired outlet quantity can also remain fixed, so that the inoperative position corresponds to the application position. As a function o the film formation shielding is then good or better and drying out good or worse.

If in the case of the embodiment with a variable application slot the roll 3 is drawn over the skin in the application direction, than as a result of friction between the skin and the roll, the roll is rotated in the direction of the arrow R and is consequently pivoted out into the application position and maintained there. If the roll 3 is rotated in the opposite direction to arrow R, it is pivoted into the inoperative position and maintained there. If the roll 3 is in its application position, but is no rotated further in the application direction, which is the case immediately following application, then it is retracted by the surface tension of the preparation surface in the slot C into the inoperative position. Thus, the physical characteristics of the preparation are utilized for reclosing the slot C following application. The surface is under a tension, which attempts to reduce the latter to a minimum. If the bearings 23 are constructed in such a way that he bearing forces which have to be overcome for pivoting the roll 3 are smaller than the forces resulting from the surface tension, then the roll is moved into the inoperative position as soon as it is not pressed by the application movement in the opposite direction. If, after closing the slot C by the surface tension, the applicator is left to itself, due to the drying out of the preparation surface in the slot C, a skin forms which shields the remaining preparation in the supply system from the outside. This shielding is sufficient to prevent further drying out of the preparation and to protect it e.g., against oxidants and bacteria. Upon further application, the skin covering the slot C is immediately torn and in no way disturbs application.

Tests have shown that the physical characteristics of a large number of commercially available skin preparations for shaving purposes meet the requirements of the above-described shielding mechanism, i.e., are suitable for use in the inventive applicator, no matter whether it has a variable or a fixed application slot.

Due to the fact that the slot or gap A between the lip 33.1 and the roll 3 in each pivoting position of the roll (open/closed or fixed corresponding to open) is very small, the channel 32 of the side of the lip 33.1 is always closed with respect to the outside. In the inoperative and application positions of the roll 3 it is consequently not possible for preparation to pass in this direction to the outside. In the application position, no contamination carried from the skin by the roll can move past the lip 33.1 into the channel 32. In the embodiment with the fixed slot this is only possible to a reduced extent.

For the additional protection and closure of the applicator, it can also be provided with a cover which is placed on the applicator at the end of application and which is shaped in such a way that it either presses the roll 3 against both lips 33.1 and 33.2 or only covers the application slot. In place of a protective cap it is additionally possible to provide mechanical pressing means, e.g., springs, so as to press the application roll 3 against the closing lip. This can be necessary if, e.g., such a razor is exposed to pronounced pressure fluctuations when designed as a travelling razor or shaver and additional closing force is sought.

FIG. 3*b* is a section through a further embodiment of the inventive applicator with a variable slot. It shows the same parts as in the applicator of FIG. 3*a*, but on its head part 21 is placed a blade carrier 34 with blades 2, such as by means of a sliding and snapaction fastening. The roll 3 is advantageously as long as the width of the blade or blades 2. The blade carrier 34 is so engaged on the head part 21 that the roll runs parallel to the blades and, if the razor head is moved over the skin in the shaving or application direction, is rotated in the direction R and pivoted into the application position.

The applicator with application roll 3, head part 21 and bearing parts 22 can be integrated into a replaceable blade carrier, which can therefore be mounted or replaced as a whole with respect to a razor head. This solution offers hygienic advantages, because the application roll coming into contact with the skin is periodically replaced with the blades. By appropriate measures the supply part located on the blade carrier is connected to the supply part located on the razor.

FIG. 4*a* is a diagrammatic longitudinal section through an embodiment of the inventive feed device which mainly comprises a small or miniature pump 5 and a reservoir 6, which together form the handle 4 of the applicator, of which are housed in a corresponding handle. As shown, the reservoir 6 is housed in the end 4.1 of the handle remote from the applicator (handle reservoir part), where an adequate volume has no prejudicial effect. The miniature pump 5 is advantageously arranged in such a way that it can be operated during application, i.e., its operating members are located in the vicinity of the fingers holding the handle during application, i.e., on the handle end facing the applicator, and forms the handle pump part 4.2. The handle is connected by the connecting part 4.3 to the applicator supply system. The main components of the miniature pump are a bellows 41, whose internal volume can be reduced, as one-way valve 42, which functions as the outlet vale for the reservoir 6 and a second one-way valve 43, which functions as the inlet valve in the applicator.

If the bellows 41 is compressed, then an overpressure occurs in its interior and opens the inlet valve 43, so that preparation or air flows into the applicator until the pressure balances itself out and the inlet valve 43 closes again. If the bellows is now released and returns to its original shape, then a vacuum occurs in its interior, so that the outlet valve 42 opens and preparation is conveyed out of the reservoir until the pressure balances itself again and the outlet valve 42 closes. By alternate compression and release of the bellows, sufficient preparation can be pumped into the applicator for filling the supply bore 31 and the channel 32 (FIG. 3) and the preparation carried to the outside by the roll 3 is continuously replaced. So as to permit pressure compensation for the reduced volume resulting from pressing preparation out of the reservoir, the latter is provided with corresponding pressure compensating means, which can be a piston 48 movable in the reservoir 6 or a pressure compensating valve.

As the miniature pump simultaneously serves as a handle, but the bellows has too little stability for this function, within the bellows 41 is fitted an internal pump body 44, which in the embodiment shown is shaped like a tube, is fixed to the handle reservoir part 4.1 and is connected to the connecting part 4.3, while being provided with openings 45 for pressure compensation purposes. Due to the fact that the inner pump body is bent at an angle, together with other parts of the feed device it forms an ergonomic handle. The bellows 41 is inverted over the inner pump body 44 and fixed with elastically deformable means 46, e.g., retaining rings.

In the embodiment shown, the two one-way valves 42 and 43 are diaphragm valves. A resilient diaphragm 47.1 keeps the reservoir outlet in a force-free state and a corresponding diaphragm 47.2 keeps the inlet to the applicator closed. The two diaphragms are arranged in such a way that in the case of an overpressure within the bellows the diaphragm 47.2 is deformed, whereas diaphragm 47.1 is deformed in the case of a vacuum. The diaphragms are so designed that in the deformed state they give passage to the preparation. FIGS. 4*b* to 4*d* show examples of diaphragms suitable for use. FIGS. 4*b* and 4*c* show hollow spherical diaphragms, which embrace perforations D located outside the area of the opening to be closed, while FIG. 4*d* shows a rectangular diaphragm, which gives passage for the preparation due to the fact that it does not cover the entire internal cross-section of the handle.

Figure 5B:
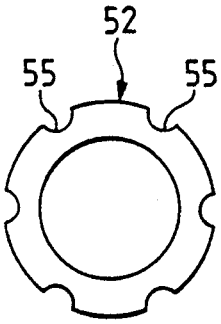
FIG. 5*b* is an end view of a sleeve usable in the embodiment of FIG. 5*a;*
Figure 5A:
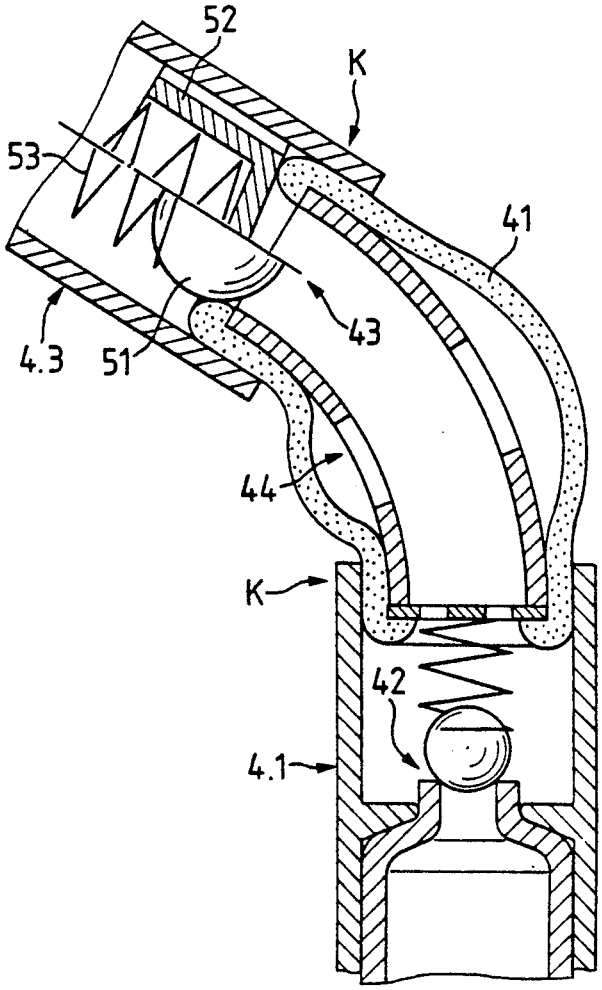
FIG. 5*a* is a partial side elevation, in section, of the pump and valve portion of yet another embodiment of the invention.

FIG. 5 shows another embodiment of the miniature pump. The actual pump is designed in the same way as that of FIG. 4, but has different one-way valves 42, 43 which, as shown in FIG. 5*a*, can be ball or piston-type valves. A ball 51 or a piston 52 is pressed against the opening to be closed by a spring 53 in a direction opposite to the compressive force produced by the bellows 41. The spring 53 is so designed that the compressive force which can be produced with the bellows 51 is higher than the spring tension. The piston 52 must ensure a passage for the preparation, so that on its cylindrical surface it can be given grooves 55, shown in the detail drawing 5*b*.

Unlike in the embodiment shown in FIG. 4, in the embodiment of FIG. 5 the advantageously metallic, inner pump body 44 is a separate part, while the reservoir part 41 of the handle and the connection part 4.3 to the applicator are equipped with elastically deformable clamping connections at the ends K. For producing the feed device the bellows 41 is inverted over the pump body 44 and then the reservoir part 41 of the handle and the connection part 4.3 are mounted. Apart from its function as the pump part, the bellows 41 assumes the function of a sealant between the different parts of the feed device.

Figure 5C:
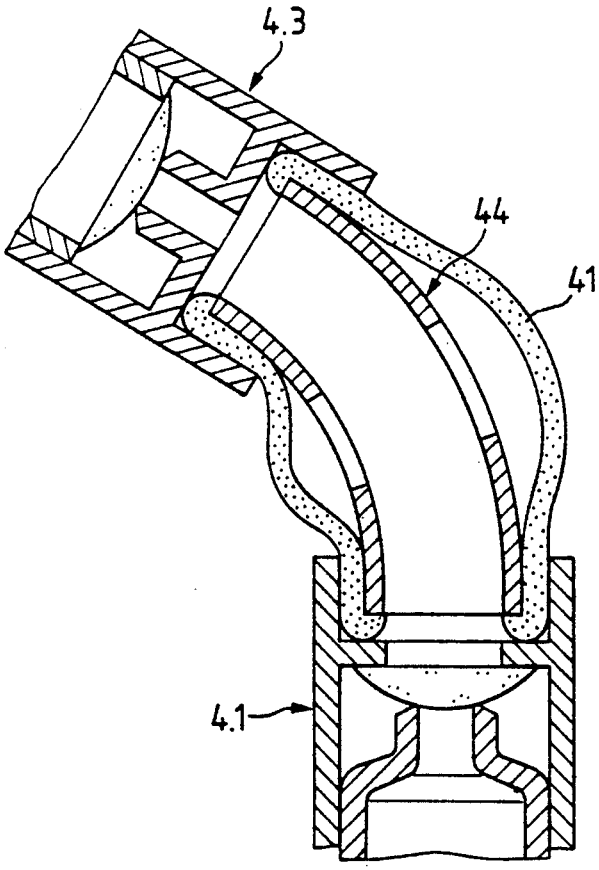
FIG. 5*c* is a partial side elevation, in section, of a further embodiment of the invention.

The nature of the one-way valves used is not bound by a special variant of the miniature pump. This is illustrated by FIG. 5*c*, which shows the same variant as FIG. 5*a*, but which is provided with diaphragm valves. It is also conceivable to have variants as in FIG. 4, but with ball or piston-type valves.

Figure 6:
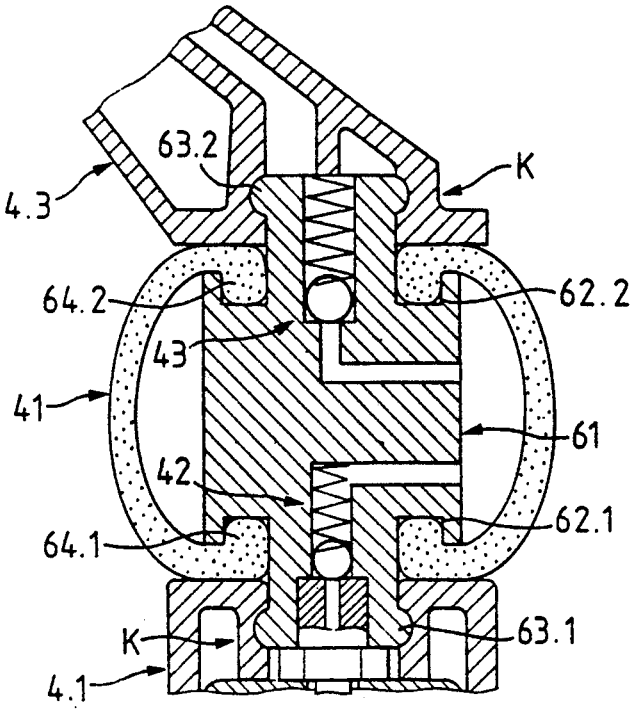
FIG. 6 is a partial side elevation, in section, of another embodiment of a valve and pump structure in accordance with the invention.
Figure 7A:
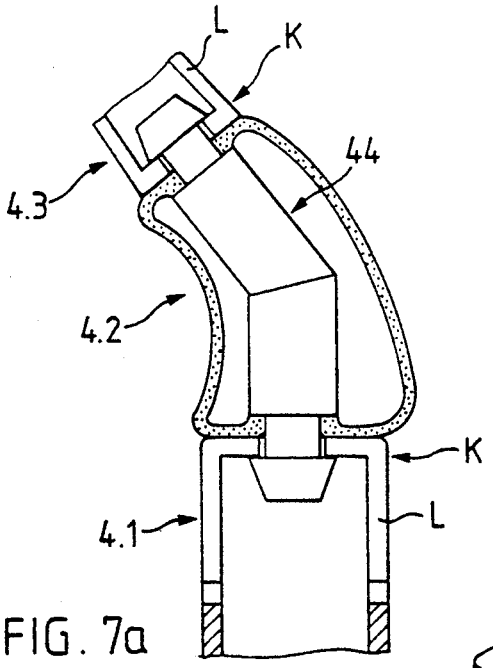
FIG. 7*a* is a partial side elevation, in section, of yet another embodiment of a valve and pump in accordance with the invention.
Figure 8:
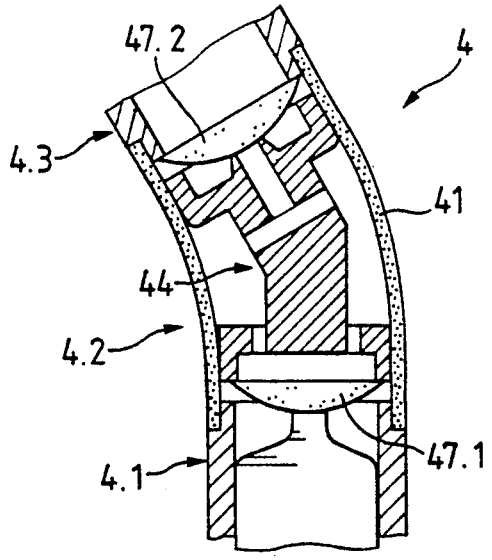
FIG. 8 is a side elevation, in section, of a still further embodiment of a pump and valve structure in accordance with the invention.

FIGS. 6 to 8 show further embodiments for the miniature pump and its connections to the handle reservoir part 4.1 and the applicator connection part 4.3.

The embodiment shown in FIG. 6 contains an inner pump body, which is shaped like a block with corresponding bores containing the one-way valves 42 and 43. The pump body 61 is provided with slots 62.1 and 62.2 and with stops 63.1 and 63.2 in such a way that the correspondingly shaped bellows 41 can be inverted over the body and the thickened bellows ends 64.1 and 64.2 come to rest in the slots 62.1 and 62.2 while the parts 4.1 and 4.3, once again provided with elastically deformable connection parts K, can be engaged over the stops 63.1, 63.2.

Figure 7B:
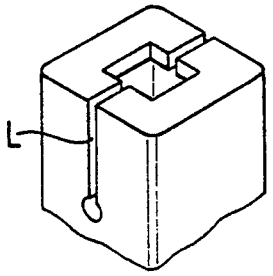
FIG. 7*b* is a partial perspective view of a connection part usable in the embodiment of FIG. 7*a;*

FIGS. 7*a* and 7*b* show another embodiment of the miniature pump and its connections to the reservoir part 4.1 and the connection part 4.3. Here again the reservoir part 4.1 and the connection part 4.3 have elastically deformable connection pars K in that, as shown in FIG. 7*b*, they are equipped with a longitudinal slot L. At its two ends the pump body 44 is given a plug-shape, so that the reservoir part 4.1 and connection part 4.3 can be easily engaged. The sealing function is here again taken on by the correspondingly shaped ends of the bellows 41 inverted over the pump body 44.

FIG. B shows an embodiment of the miniature pump which is advantageous due to its simplicity. The reservoir part 4.1, pump body 44 and connection part 4.3 of the handle 4 are held together, e.g., bonded or welded, by the tubular bellows 41. The diaphragms 47.1 and 47.2 are located between the reservoir part 4.1 and pump body 44 or between the connection part 4.3 and pump body 44. The elastic, tubular bellows 41 connects the individual parts of the handle, seals all the connections and serves as a pump operating member.

Figure 9:
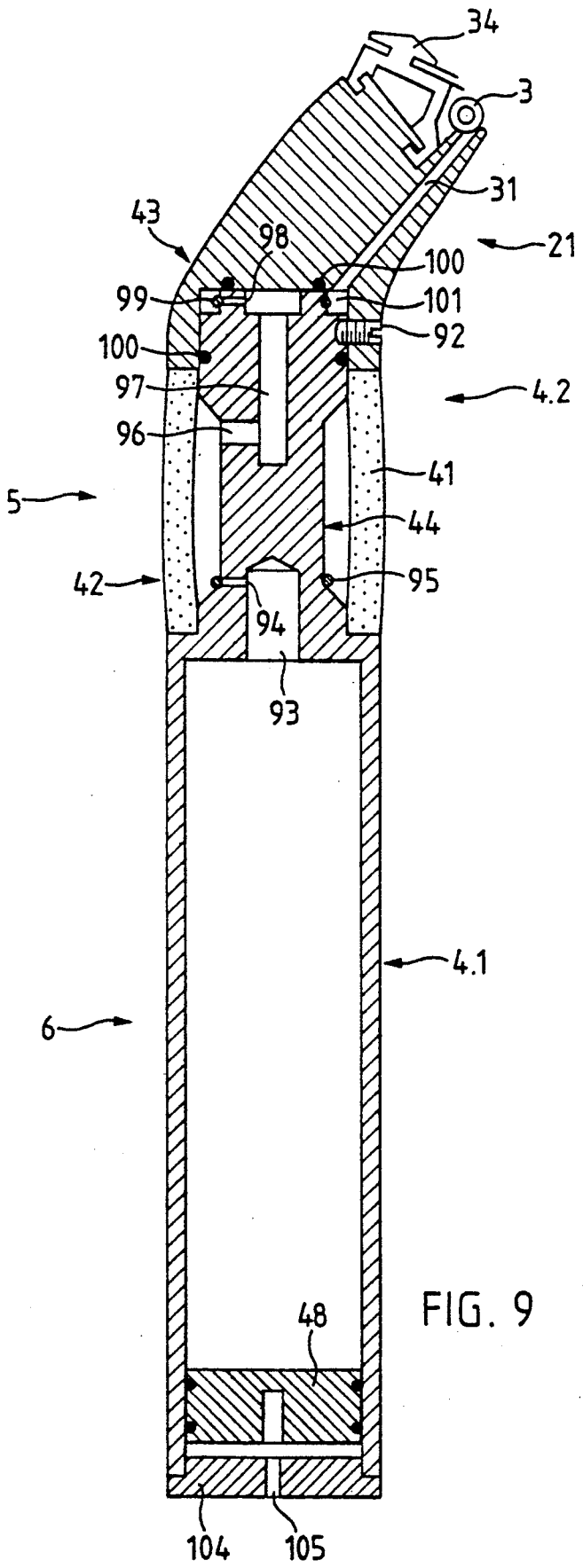
FIG. 9 is a side elevation, in section, of a complete shaving apparatus in accordance with the invention.

The embodiment of FIG. 9 is a complete razor comprising a feed device, applicator and cutting mechanism, which is mounted in the form of a blade carrier with blades on the applicator.

A miniature pump 5 and reservoir 6 form the handle. To the miniature pump 5 is directly connected the applicator head 21, which is so constructed that a blade carrier 34 can be mounted on it. The applicator corresponds to the embodiment described relative to FIG. 3*b*. The miniature pump 5 comprises a cylindrical pump body 44, whose diameter at its two ends is larger than in its central part and a tubular bellows 41, which is inverted over the central part of the pump body 44. The reservoir 6 is fixed to the pump body. The applicator comprises a connection part which overlaps the pump body and is fixed to the latter, e.g. with the aid of fastening screws 92. The two one-way valves 42,43 are integrated into the pump body 44. The outlet valve 42 from the reservoir comprises an axial bore 93, which extends from the reservoir-side face into the reduced diameter portion and issues there into at least one radial opening 94. The outlet of the opening 94 is closed by an 0-ring 95. The inlet valve 43 to the applicator comprises a radial opening 96 in the reduced diameter portion of the pump body and which issues into an axial bore 97, which is sealed at the applicator-side end face by the applicator head 21 and by the O-ring 100. Into the axial bore 97, against the end face of the pump body issues at least one radial opening 98, whose outlet is sealed with an O-ring 99 at the slightly reduced external diameter of the pump body 44 at this point. The applicator supply channel 31 issues directly into the annular channel 101 resulting from the diameter reduction. Vacuum in the space between the bellows 41 and the pump body 44 presses the O-ring 95 away from the opening 94, while overpressure presses the O-ring 99 away from the opening 98.

The feed device reservoir 6 here forms the handle reservoir part 4.1. It carried in its interior an axially movable piston 48 and at its end remote from the miniature pump and terminating piece 104 with a ventilating opening 105. If the miniature pump pumps preparation out of the reservoir, the piston 48 moves toward said pump until the pressure is compensated.

The feed device embodiment according to FIG. 9 typically makes it possible for a half drop of preparation (approximately 25 microliters) to be dosed for each pump movement. If, e.g., four drops of preparation are required for a shave, this means that the pump must be operated every 15 to 20 seconds. A reservoir volume of 10 cc which can easily be integrated into a handle is in this case adequate for approximately 50 shaves.

In conjunction with the further drawings further embodiments of the applicator will be shown, based in each case on the razor embodiment according to FIG. 9, i.e., with a cutting mechanism mounted on the applicator. Obviously corresponding embodiments are also conceivable for cutting mechanisms, e.g., integrated in the applicator and also combined with any other feed devices.

The application roll can be designed in surfacestructured manner (no drawing), which ensures certain advantages, such as better frictional adhesion to the skin and better fluid transport, but also suffers from disadvantages, such as the drying out of the fluid in the depressions of the structure and also a "back-transport" of consumed fluid into the vicinity of the fluid supply channel.

Figure 10:
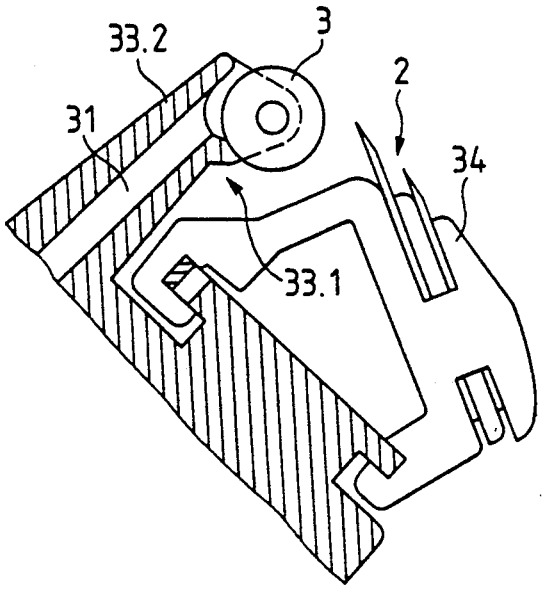
FIGS. 10 and 11 are partial side elevations, in section, of a shaving apparatus head showing variations in the mounting arrangements of an application roll.

For a simpler embodiment the application roll need not be pivotable, i.e., it is only rotatable or can be rigidly connected to the lips 33.1 and 33.2, as shown in FIG. 10. In the inventive manner, it then functions as a means for distributing the fluid on the skin, for locally sliding back the skin immediately prior to the cutting edges passing over the same and for the partial, but non-variable covering of the supply channel 31.

Figure 11:
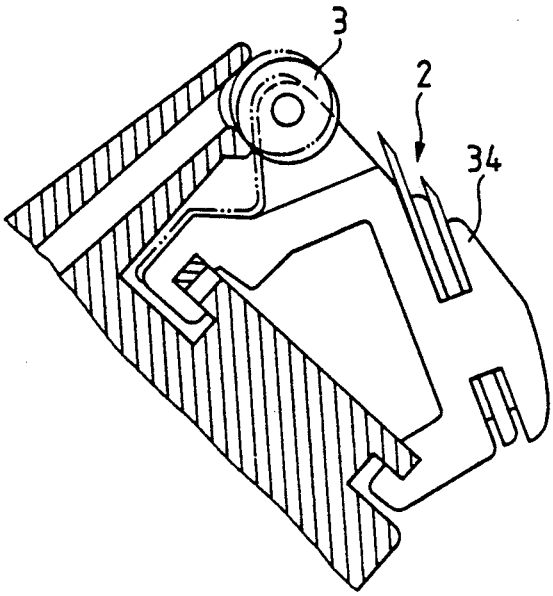
Figure 12A:
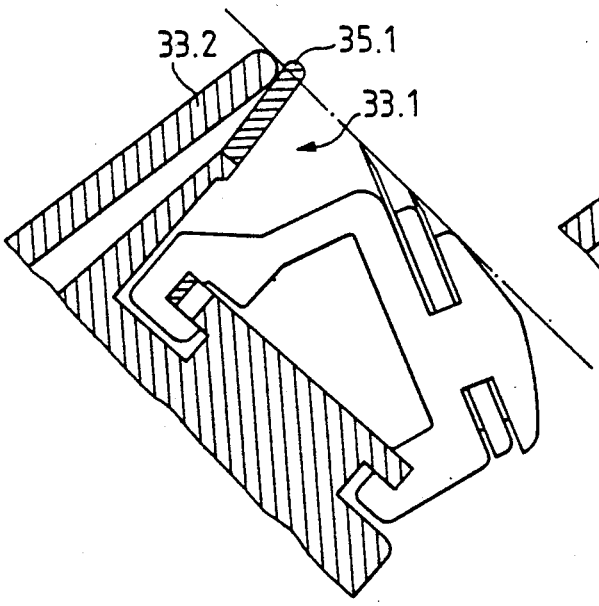
FIGS. 12*a* and 12*b* are partial side elevations, in section, of a shaving apparatus head with a bendable application spatula in the closed and operative positions, respectively.
Figure 12B:
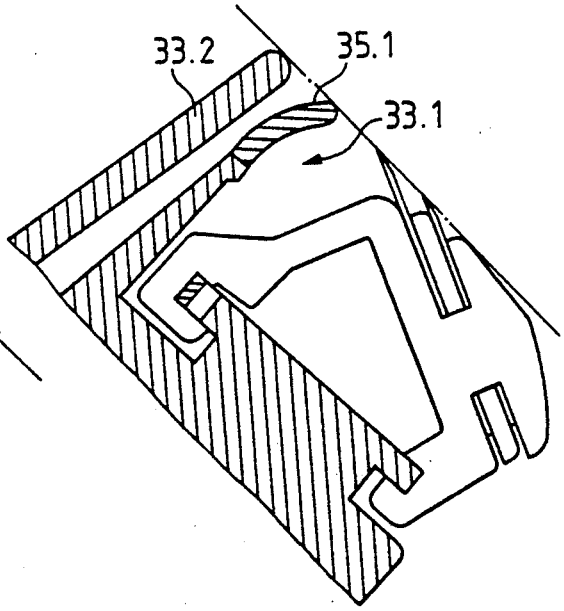
Figure 13A:
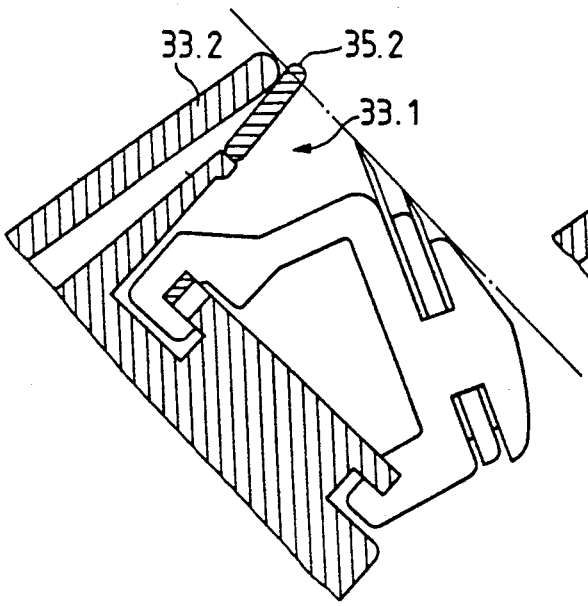
FIGS. 13*a* and 13*b* are partial side elevations, in section, of a shaving apparatus head with a hinged application spatula in the closed and operative positions, respectively.
Figure 13B:
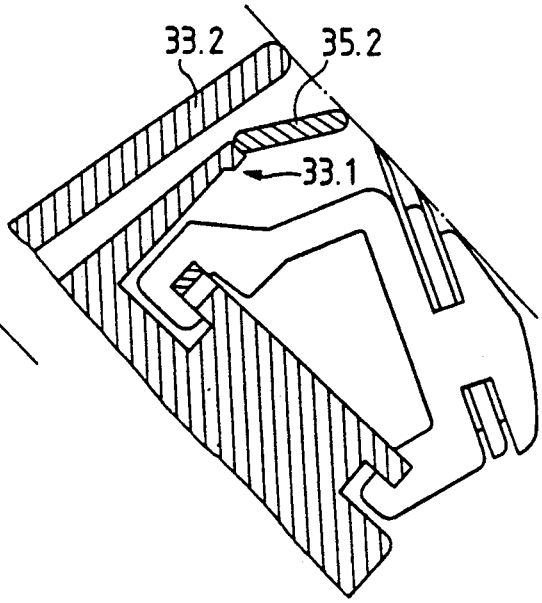
Figure 14A:
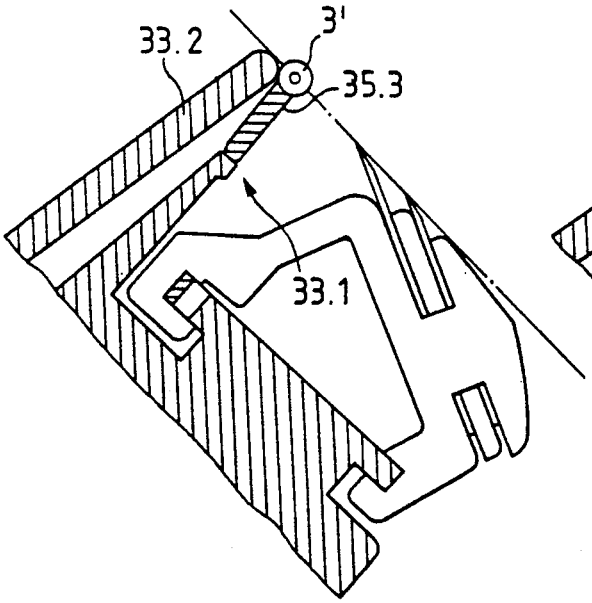
FIGS. 14*a* and 14*b* are partial side elevations, in section, of a shaving apparatus head with a hinged application spatula with a roller in the closed and operative positions, respectively.
Figure 14B:
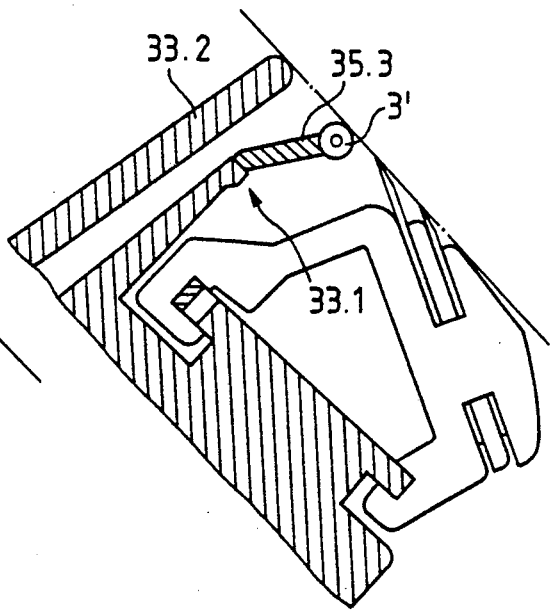

In place of a pivotable application roll, it is possible to use a slidable or resiliently mounted blade carrier 34 with an integrated, rotatably mounted or rigid application roll 3, as shown in FIG. 11. The advantage here is the constant spacing between the application roll 3 and the blade or blades 2. If the blades are resiliently mounted, there is the additional advantage of a constant contact pressure on the skin, which reduces cutting risks. In the unloaded state the supply channel 31 is closed by the spring tension, which would correspond to the embodiment with the variable supply gap.

In place of the application roll it is also possible to use an application spatula. Corresponding embodiments are shown in FIGS. 12*a*, 12*b*, 13*a*, 13*b*, 14*a*, and 14*b*, FIG. a in each case showing the inoperative position and FIG. b the application position. The inner lips 33.1 (or manipulation part of the applicator 30.2, FIG. 1) is constructed as a deflectable spatula 35 and the outer lip 33.2 is rigid, as in the previously described embodiments with an application roll. In an embodiment with a spatula the advantage is obtained that in the inoperative state the outlet gap is well sealed. Through the cutting process (i.e., in the application position), the application gap or slot is opened because the spatula is pivoted out of its inoperative position and the fluid can be delivered to the skin surface. This ensures a regulated fluid outlet onto the skin surface. In all the embodiments having the spatula the angle of cut is defined via the fixed outer lip 33.2 and the blade contact surface. For example, the fixed outer lip 33.2 can be part of the blade body.

The spatula (35.1, FIGS. 12*a* and 12*b*) can be so elastically constructed that, in the inoperative position, it closes the supply channel (FIG. 12*a*), but deflected in the application position it frees the opening of the supply channel (FIG. 12*b*), while being moved back into the inoperative position by the elastic properties of the material. The spatula (35.2, FIGS. 12*a* and 13*b*) can also be hinged via a joint to the applicator and once again closes the supply channel in the inoperative position (FIG. 13*a*), is deflected in the application position (FIG. 13*b*) and is returned e.g., by spring tension to the inoperative position. The embodiment shown in FIGS. 12*a* and 14*b* has on a hinged spatula 35.3 a rotatably mounted or rigid application roll 3', which distributes the preparation over the skin.

In place of a rigid outer lip as a counterlip to an application roll, in conjunction with the action of the feed device (pump), it is also possible to use a movable application lip. Corresponding embodiments are shown in FIGS. 15*a* and 15*b*, 16*a* and 16*b*, and 17*a* and 17*b*, once again in the inoperative position (FIG. a) and in the application position (FIG. b). All the embodiments with movable application lips at least have the same advantages as those with rigid outer lips and application rolls and also further advantages are obtainable with lip design variations.

Figure 15A:
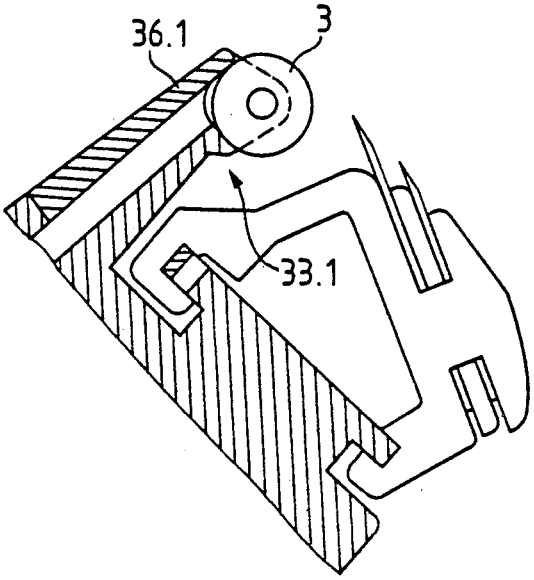
FIGS. 15*a* and 15*b* are partial side elevations, in section, of a shaving apparatus head with an application roll and a flexible lip in the closed and operative positions, respectively.
Figure 15B:
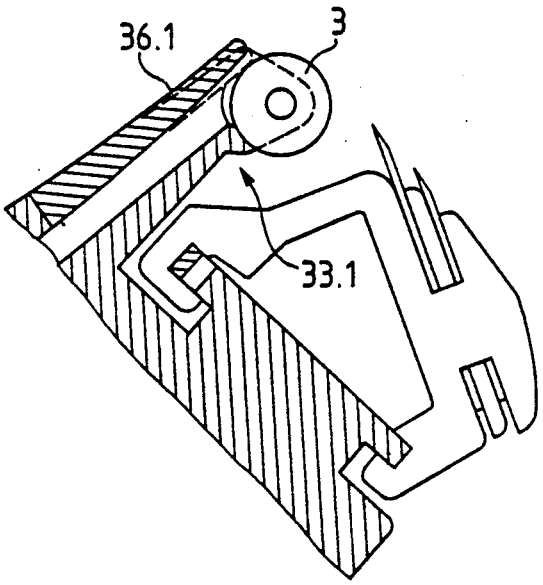
Figure 16A:
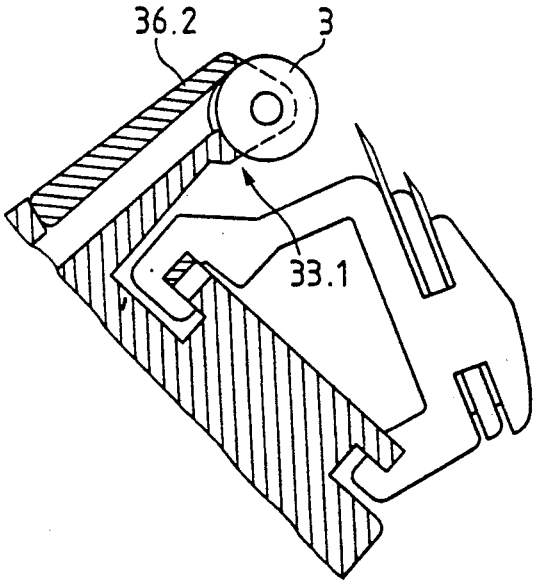
FIGS. 16*a* and 16*b* are partial side elevations, in section, of a shaving apparatus head with an application roll and a flexible lip in the closed and operative positions, respectively.
Figure 16B:
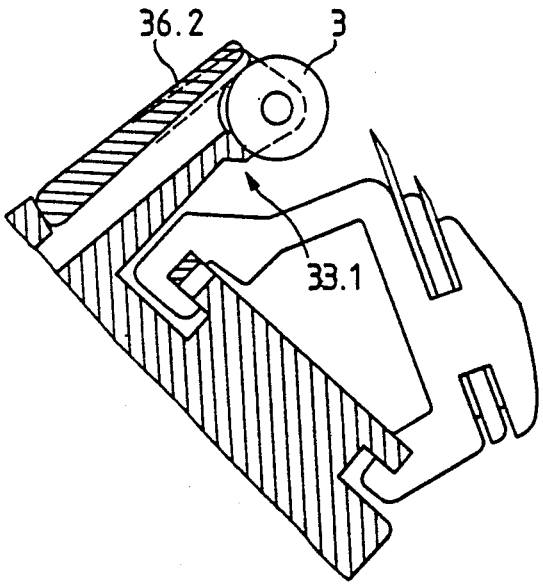
Figure 17A:
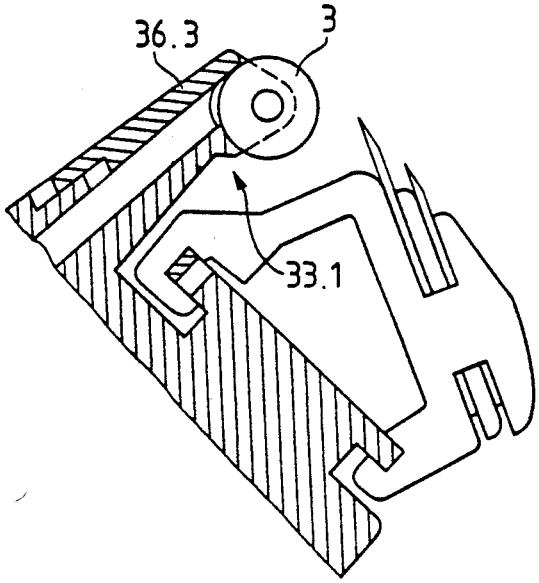
FIGS. 17*a* and 17*b* are partial side elevations, in section, of a shaving apparatus head with an application roll and a hinged outer lip in the closed and operative positions, respectively.
Figure 17B:
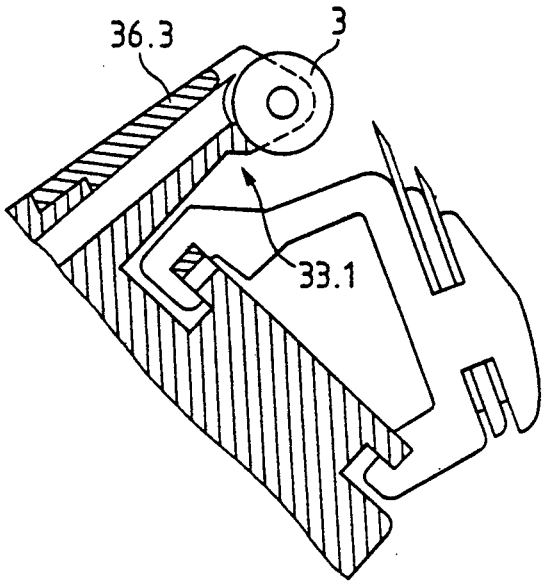

The outer lip 36.1 of the embodiment shown in FIGS. 15*a* and 15*b* is elastic. By pump pressure it is pivoted out of its inoperative position on the application roll 3 and due to the elastic properties of its material is moved back into the inoperative position again. This also applies with respect to the embodiment with the hinged outer lip 36.2 shown in FIGS. 16*a* and 16*b*, which is e.g., moved by spring tension into the inoperative position. In the case of such pivotable outer lips a considerable fluid outlet quantity regulatability is obtained via the application pump pressure and the outflowing fluid regulates the outlet gap outside the inoperative position. The pump pressure can control the outlet quantity over a wide range using deflectable lips. The pump pressure must firstly overcome the spring pressure of the lip in its basic position before the fluid can pass to the outside. Account must only be taken of the contact pressure on the skin, which acts against the pump pressure.

The embodiment shown in FIG. 7 has a manually displaceable outer lip 36.3, with the aid of which the fluid supply can be manually started, stopped and regulated. The outlet opening is consequently not self-regulating, but the opening movement can be determined independently of the pump pressure.

Figure 18A:
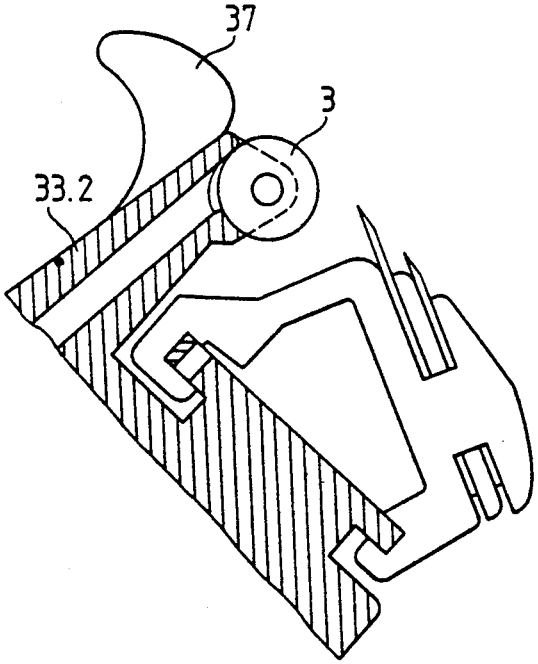
FIGS. 18*a* and 18*b* are partial side elevations, in section, of a shaving apparatus head with a count on the outer lip and a roll and a spatula, respectively, in the closed and operative positions, respectively; and FIGS., 19*a*, 19*b* and 19*c* are perspective views of differently shaped rolls and associated blades for flat and contour shaving.
Figure 18B:
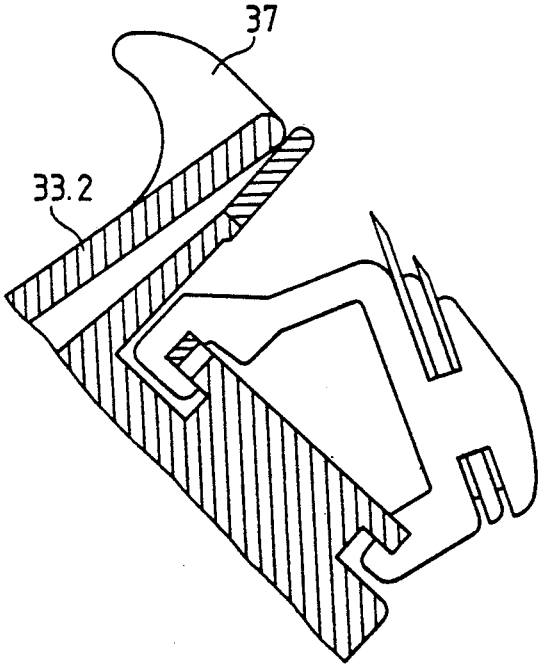

In all the embodiments the lower part of the application head can be constructed as a comb, so that as a result of a combing action the hair is offered to the blade in an oriented position. Two corresponding embodiments with a comb 37 from the outer lip 33.2 are shown in FIGS. 18*a* and 18*b*.

Figure 19A:
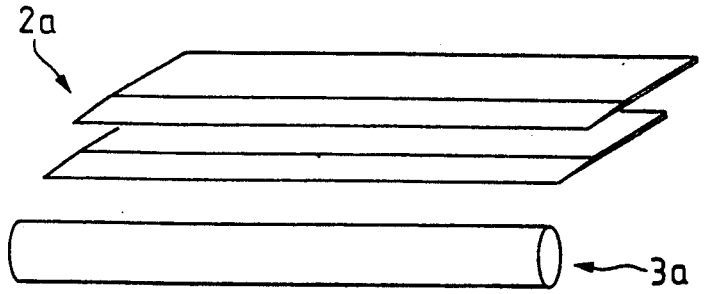
Figure 19B:
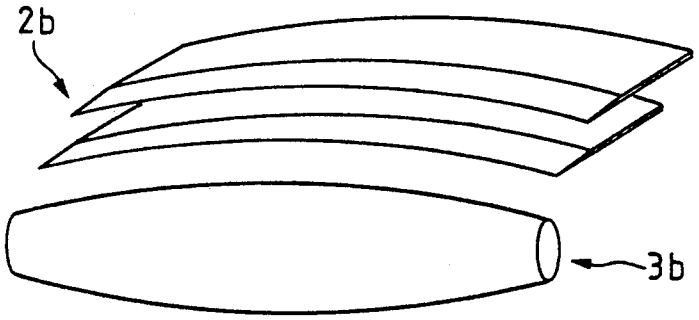
Figure 19C:
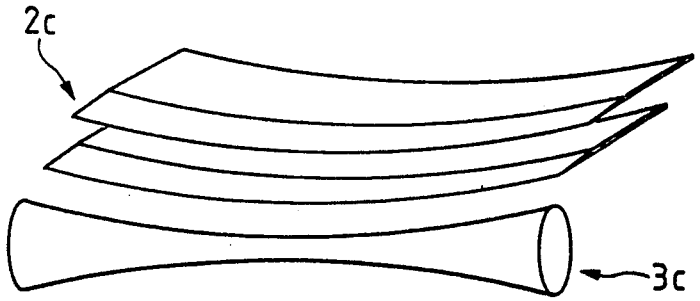

The shaver or razor head can be constructed in accordance with its use for shaving more or less flat or rounded surfaces, in that correspondingly shaped application rolls or spatulas and applicator openings and blades constructed in accordance with the function of the roll shape are used. FIGS. 19*a* to 19*c* show examples where the path of the blades essentially follows that of the application roll (such shapes being transferable to the application spatula). Divergences from this configuration may also be appropriate, but a functional relationship must 4 exist between the shape of the application roll and the blade configuration. The shown possibilities only offer hints regarding further development and consequently only one application roll 3 and blades 2 are shown in their relative arrangement. FIG. 19*a* shows a typical arrangement with a cylindrical application roll 3*a* for shaving skin surfaces which can be made flat by the application roll. FIG. 19*b* shows an arrangement with a convex application roll 3*b* for shaving concave surfaces such as depressions, e.g., in the arm-pits, which cannot be reached with the linear blade. FIG. 19*c* shows an arrangement with a concave application roll 3*c* for shaving convex surfaces such as protuberances, e.g., on the larynx, in which the linear blade would lead to an increased risk of injury. According to the already shown embodiments (and in accordance with FIGS. 1 to 1.4), there is also a shape association of the application slot of the application roll, the functional link between the fluid supply and its distribution remaining the same. Such embodiments also enable the shaving of more highly rounded surfaces.

We claim:

1. A shaving apparatus comprising the combination of a blade portion having a cutting edge;

a fluid applicator portion associated with and cooperating with said blade portion for applying a fluid to the skin of a user and for influencing the position of the skin, said applicator portion having a fluid channel, means defining an application opening at an end of said fluid channel, a substantially smooth and continuous surface spaced from said cutting edge in a direction of shaving motion for distributing said fluid and for depressing the skin ahead of said cutting edge to thereby establish a desired position of the skin ahead of said cutting edge;

a feed portion connected to said applicator portion providing a source of fluid; and discharge means connected to and between said feed portion and said applicator portion for supplying said fluid under pressure from said feed portion to said fluid channel, and wherein said substantially smooth and continuous surface comprises an application roll, and said means defining said opening includes a rigid inner lip and a rigid outer lip, said lips forming part of said fluid channel, said roll and said lips extending parallel to said cutting edge, and wherein said application roll is mounted on said inner lip adjacent said cutting edge and said outer lip is spaced from said cutting edge more than said inner lip.

2. A shaving apparatus according to claim 1 wherein said application roll is mounted for rotation about an axis.

3. A shaving apparatus according to claim 1 wherein said application roll is mounted for rotation about an axis and said axis is pivotally movable relative to said inner lip.

4. A shaving apparatus according to claim 3 wherein said application roll is rotatably mounted on a pivot pin on said axis and said pin is pivotably movable to a plurality of positions relative to said inner lip, said inner lip and said roll thereby forming a slot having a plurality of widths.

5. A shaving apparatus according to claim 4 wherein said axis is pivotable to move said roll between an application position and an inoperative position, said roll in said application position defining a slot having a width corresponding to a predetermined rate of dispensing of said fluid therethrough.

6. A shaving apparatus according to claim 1 wherein said application roll is non-rotatably mounted on said inner lip.

7. A shaving apparatus according to claim 1 wherein said application roll has a cylindrical outer surface.

8. A shaving apparatus according to claim 1 wherein said application roll is pivotally mounted with respect to said inner lip.

9. A shaving apparatus according to claim 1 wherein said application roll has a convex application surface.

10. A shaving apparatus according to claim 1 wherein said application roll has a concave application surface.

11. A shaving apparatus comprising the combination of a blade portion having a cutting edge;

a fluid applicator portion associated with and cooperating with said blade portion for applying a fluid to the skin of a user and for influencing the position of the skin, said applicator portion having a fluid channel, means defining an application opening at an end of said fluid channel, means for varying the size of said opening comprising an inner lip forming a wall of said fluid channel, an application spatula on said inner lip and extending parallel to said cutting edge, and a fixed outer lip extending toward and in parallel with said cutting edge; and a substantially smooth and continuous surface spaced from said cutting edge in a direction of shaving motion for distributing said fluid and for depressing the skin ahead of said cutting edge to thereby establish a desired position of the skin ahead of said cutting edge;

a feed portion connected to said applicator portion providing a source of fluid; and discharge means connected to and between said feed portion and said applicator portion for supplying said fluid under pressure from said feed portion to said fluid channel.

12. A shaving apparatus according to claim 11 wherein said application spatula is hingedly attached to said inner lip.

13. A shaving apparatus according to claim 11 wherein said application spatula is mounted on said inner lip facing toward a skin surface of a user when said shaving apparatus is used.

14. A shaving apparatus according to claim 11 wherein said application spatula is made from an elastic material and is bendable.

15. A shaving apparatus comprising the combination of a blade portion having a cutting edge;

a fluid applicator portion associated with and cooperating with said blade portion for applying a fluid to the skin of a user and for influencing the position of the skin, said applicator portion having a fluid channel, means defining an application opening at an end of said fluid channel, means for varying the size of said opening comprising a rigid inner lip adjacent to and parallel to said cutting edge and an outer, and a spatula on said outer lip extending parallel to and spaced from said cutting edge; and a substantially smooth and continuous surface spaced from said cutting edge in a direction of shaving motion for distributing said fluid and for depressing the skin ahead of said cutting edge to thereby establish a desired position of the skin ahead of said cutting edge;

a feed portion connected to said applicator portion providing a source of fluid; and discharge means connected to and between said feed portion and said applicator portion for supplying said fluid under pressure from said feed portion to said fluid channel.

16. A shaving apparatus according to claim 15 wherein said spatula is hingedly attached to said outer lip.

17. A shaving apparatus according to claim 15 wherein said spatula is made from an elastic material.

18. A shaving apparatus according to claim 15 wherein said spatula is displaceably mounted relative to said outer lip.

19. A shaving apparatus comprising the combination of a blade portion having a cutting edge;

a fluid applicator portion associated with and cooperating with said blade portion for applying a fluid to the skin of a user and for influencing the position of the skin, said applicator portion having a fluid channel, means defining an application opening at an end of said fluid channel, means for varying the size of said opening, and a substantially smooth and continuous surface spaced from said cutting edge in a direction of shaving motion for distributing said fluid and for depressing the skin ahead of said cutting edge to thereby establish a desired position of the skin ahead of said cutting edge;

a feed portion connected to said applicator portion providing a source of fluid;

discharge means connected to and between said feed portion and said applicator portion for supplying said fluid under pressure from said feed portion to said fluid channel; and comb means mounted on said means for varying the size of said opening and extending parallel to said cutting edge.

* * * * *